United States Patent [19]

Markovetz

[11] Patent Number: 4,827,812

[45] Date of Patent: May 9, 1989

[54] POCKET SCREWDRIVER

[76] Inventor: Donald J. Markovetz, 5344 Malad, Boise, Id. 83705

[21] Appl. No.: 244,086

[22] Filed: Sep. 14, 1988

[51] Int. Cl.[4] ..... B25B 23/00

[52] U.S. Cl. ..... 81/439; 81/490; 81/177.5; 81/177.4

[58] Field of Search ..... 81/438, 439, 490, 492, 81/177.5, 177.4

[56] References Cited

U.S. PATENT DOCUMENTS

| | | | |
|---|---|---|---|
| 1,468,715 | 9/1923 | Guerrieri | 81/490 |
| 1,555,109 | 9/1925 | Eliason | 81/439 |
| 2,022,775 | 12/1935 | Holliano-Letz | 81/439 |
| 2,641,291 | 6/1953 | Yess | 81/177.5 X |
| 2,683,931 | 7/1954 | Fahlgren | 81/438 X |
| 2,825,374 | 3/1958 | Reid | 81/438 |
| 4,235,269 | 11/1980 | Kraus | 81/438 |
| 4,399,723 | 8/1983 | Marleau | 81/438 X |

*Primary Examiner*—James G. Smith

*Attorney, Agent, or Firm*—Frank J. Dykas; Craig M. Korfanta

[57] ABSTRACT

A pocket screwdriver 10 having a hollow shaft 11, one end of which is contoured to receive the hexagonal shaft 25 of a standard interchangeable screwdriver bit, 13 or 18, a thrust bearing magnet 17 for magnetically attaching to the standard hexagonal bit, a storage compartment 23 for storing one or more interchangeable hexagonal bits, a shirt pocket clip 15 attached to the hollow shaft 11 and a torque cap 12 which can be radially attached to the shaft thereby acting as torque amplification means.

6 Claims, 5 Drawing Sheets

18

13

POCKET SCREWDRIVER

BACKGROUND OF THE INVENTION

1. Technical Field

This invention generally relates to pocket screwdrivers, and more particularly, to pocket screwdrivers having a plurality of tool bits and means for increasing applied torque.

2. Background Art

Pocket screwdrivers are longstanding within the hand tool art. However, even though pocket screwdrivers are well known within the art, they are not widely used among mechanics and handymen. Several deficiencies exist in the presently available pocket screwdrivers which contribute to their limited use. One major complaint is the that any screwdriver small enough to fit within a shirt pocket, which is the most convenient place to carry them, is too small to efficiently grip and therefore, applies insufficient torque to the screw head. Another complaint, is that the present day pocket screwdrivers are not versatile, in that you must carry separate screwdrivers for each type of screw i.e. both Phillips and standard slotted screws. Additionally, pocket screwdrivers have substandard sized heads which make it difficult when attending to a standard sized slot in a screw. Presently, there are available, mini sized drivers which have a plurality of miniature interchangeable bits. In addition to not being able to satisfactorily attend to standard sized slots, these miniature bits are all but irreplaceable when lost. The vast majority of hardware stores do not carry substandard sized, interchangeable tool bits, as there is no industry standard for the shank size of the driving tool for miniature bits.

STONE, U.S. Pat. No. 537,246, teaches a pocket screwdriver which has a plurality of screwdriver bits pivotally attached to a telescoping inner carriage, wherein the desired bit is selected and the carriage is inserted back into the screwdriver housing. The screwdriver of STONE has two main drawbacks, the first being that the carriage is not well suited to the addition of a Phillips head bit, and the second being, that the torque amplification means provided to the screwdriver makes the screwdriver too bulky to be carried within a shirt pocket. For instance, it is common practice for a gas station attendant to carry several pens and a tire gauge in his front shirt pocket. There is simply not room for a bulky pocket screwdriver, nor, is the additional weight of such a bulky device desirable.

In a much more recent teaching, JOHNSON, U.S. Pat. No. 3,561,510, discloses a torque amplification means extending radially outward from the shank of the screwdriver. JOHNSON does not teach, however, the use of his torque amplification means with a pocket sized screwdriver, nor, the use of interchangeable bits. One of the problems with modifying the device of JOHNSON to meet the objectives of the present invention, is that there is no place to store the torque amplification means taught by JOHNSON.

What is needed is a pocket screwdriver, which can easily be carried in a front shirt pocket, which is capable of attending to standard sized screws, whether they be of the straight slot or Phillips head variety. Accordingly, it is the object of the present invention to provide a pocket screwdriver that can be stored in a front shirt pocket and which advantageously uses standard sized interchangeable tool implements, thereby adding versatility. A further object is to provide a pocket screwdriver which includes a torque amplification means for aiding in the setting and dislodging of screws.

DISCLOSURE OF INVENTION

These objects are accomplished by constructing a pocket screwdriver using a hollow shaft, one end of which is contoured to receive the hexagonal shaft of a standard interchangeable screwdriver bit, a thrust bearing magnet for magnetically attaching the hollow shaft to the standard hex bit, a storage compartment in the hollow shaft for storing one or more interchangeable bits, a shirt pocket clip attached to the hollow shaft and a torque cap which can be radially attached to the hollow shaft thereby acting as torque amplification means. The magnet is securely attached to the inside of the hollow shaft a known distance from the contoured end, wherein the known distance corresponds to the length of the hexagonal shaft of the tool bit. The magnet further divides the interior of the hollow shaft into an upper storage compartment the lower hexagonal tool bit receiving compartment. A radially penetrating hole is disposed within the hollow shaft walls defining the storage compartment and is sized for receiving a segment of the torque cap when radially inserted therethrough.

BEST MODE FOR CARRYING OUT INVENTION

Figure 1:
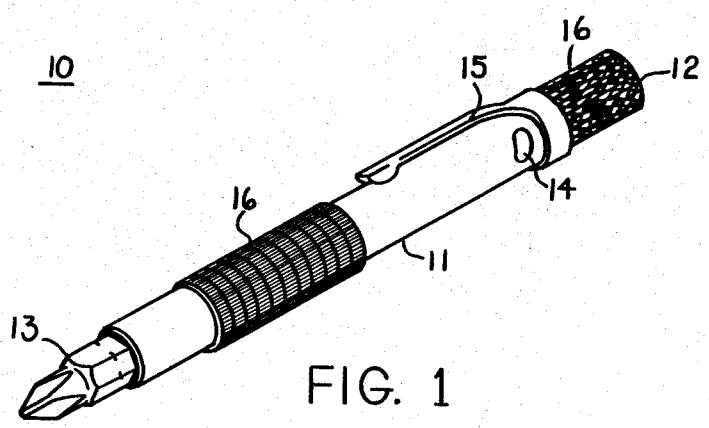
FIG. 1 is a perspective view of a pocket screwdriver.
Figure 2:
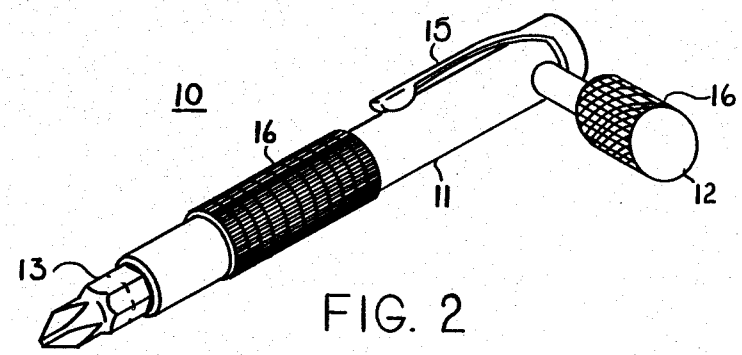
FIG. 2 is a perspective view of a pocket screwdriver showing the torque amplification means to advantage.

FIG. 1 shows pocket screwdriver 10 configured for convenient storage in a pocket, such as the front pocket of a work shirt or coveralls. Pocket screwdriver 10 has a hollow shaft 11, torque cap 12, Phillips head screwdriver bit 13, torque cap receiving hole 14, shirt clip 15 and knurled surfaces 16, all of which compose the configuration shown in FIG. 1. Referring also now to FIG. 2, torque cap 12 is shown inserted through torque cap receiving hole 14. This particular configuration provides a superior torque amplification means which allows the user to apply ample torque to a screw.

Figure 3:
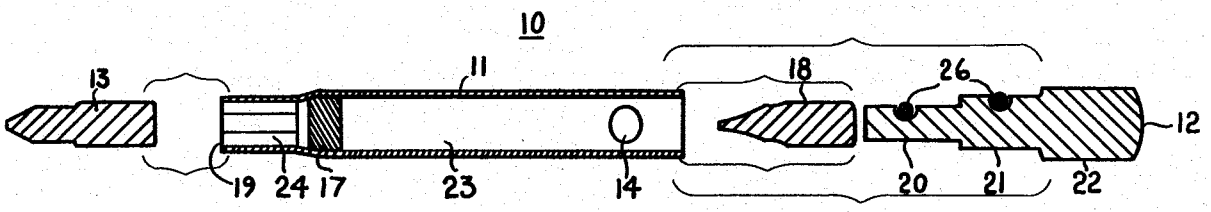
FIG. 3 is a side sectional exploded view of a pocket screwdriver.
Figure 4:
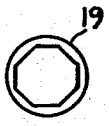
FIG. 4 is an end view of the first end of a pocket screwdriver.
Figure 6:
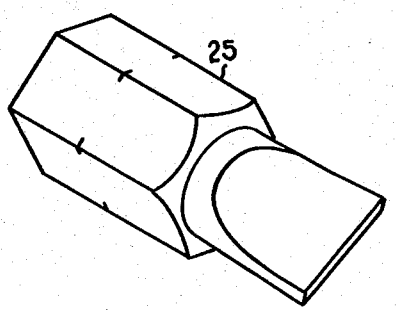
FIG. 6 is a hexagonal shaft slotted screwdriver bit.
Figure 5:
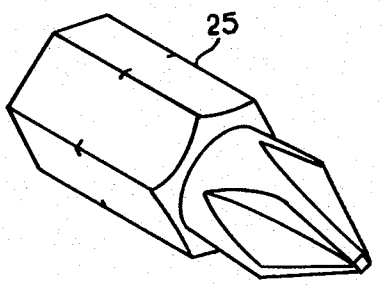
FIG. 5 is a perspective view of a hexagonal shaft Phillips head screwdriver bit.

The details of the construction of a pocket screwdriver 10 are shown in an exploded view, FIG. 3. FIG. 3 shows pocket screwdriver 10 having both a Phillips head screwdriver bit 13 and slotted head screwdriver bit 18, at least one of which may be stored in storage compartment 23. Hollow shaft 11 has a magnet 17 attached to its inner walls at a point along its longitudinal axis which divides hollow shaft 11 into storage compartment 23 and tool receiving compartment 24. Tool receiving end 19 has its interior surface contoured to receive the hexagonal shank of either tool bits 13 or 18, as is best shown in FIG. 4. FIGS. 5 and 6 depict Phillips head screwdriver bit 13 and slotted screwdriver bit 18 respectively. Both tool bits, 13 and 18, are constructed from a paramagnetic material and equipped with a hexagonal shaft 25, which is of known length. Being paramagnetic, both tool bits are attracted to magnet 17 when inserted within the tool receiving chamber 24 or storage chamber 23, all components of which are shown in FIG. 3.

Referring again to FIG. 3, torque cap 12 is composed of three segments, a first segment 20, second segment 21 and third segment 22. First segment 20 is sized for insertion into torque cap receiving hole 14. Second segment 21 is coaxially aligned with first segment 20 and attached thereto, and is sized for insertion into the storage compartment end of hollow shaft 11. Third segment 22 is coaxially aligned with and attached to the other end of second segment 21. Segments 20 and 21 are fitted with detent balls 26 which act to engage torque cap receiving hole 14 for holding torque cap 12 in engagement therewith.

Figure 7:
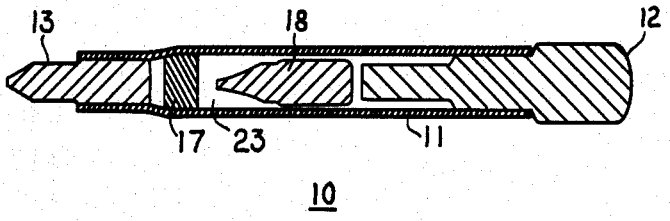
FIG. 7 is a sectional side view of a pocket screwdriver.

FIG. 7 shows in cross-section, how the various components are assembled to form the configuration of FIG. 1. While hollow shaft 11 is depicted as being a cylindrical shaft, it should be apparent that it could just as easily be square, hexagonal, elliptical, etc.

Figure 8:
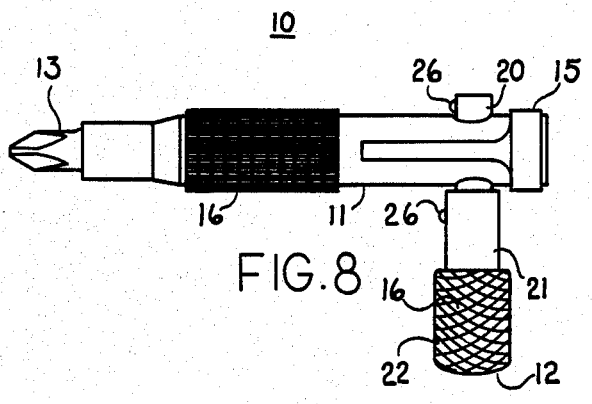
FIG. 8 is a plan view of a pocket screwdriver showing the torque amplification means to advantage.

FIG. 8 shows the configuration of FIG. 2 from a second vantage point which shows torque cap 12 being radially engaged with torque cap receiving hole 14 in hollow shaft 11.

In use, pocket screwdriver 10 exhibits several unobvious and advantageous characteristics. When one of the paramagnetic bits, 13 or 18, is engaged in the tool engaging compartment 24 and with magnet 17, its paramagnetic characteristics act to attract a metallic screw, which is very advantageous when starting the screw. Further, the tool bit stored in storage compartment 23 will tend to adhere to magnet 17, making it much more difficult to loose the bit when torque cap 12 is not disposed in either of the two configurations shown in FIGS. 1 or 2. However, if either bit, 13 or 18, should be lost, they are easily replaced as they are common to inventories of most hardware stores.

While there is shown and described the present preferred embodiment of the invention, it is to be distinctly understood that this invention is not limited thereto but may be variously embodied to practice within the scope of the following claims.

I claim:

1. A pocket screwdriver which comprises:

a hollow shaft having first and second ends;

said first end having an interior surface contoured for engagement with a known length of a hexagonal shaft of a tool bit;

a magnet attached to the interior of the hollow shaft at a point along the longitduinal axis of said shaft for magnetic attachment to the end of the known length of a tool bit's hexagonal shaft, said magnet being used for receiving thrust imparted through the tool bit to said hollow shaft and for magnetically holding the hexagonal shaft of a tool bit in said first end;

said magnet further defining an upper compartment within said hollow shaft, said compartment further being sized for receiving a tool bit for storage therein, and said compartment being accessible through said second end;

said shaft further having a radially penetrating hole disposed at a point along the longitudinal axis between said magnet and said second end;

a plurality of paramagnetic tool bits each having a hexagonal shaft of known length for engagement with said first end and said magnet;

a torque cap having a first segment having an outside dimension sized for insertion into said radially penetrating hole, a second segment coaxially attached to and aligned with said first segment, said second segment having an outside dimension for insertion into said second end, and a third segment coaxially aligned with said second segment, said third segment having an outside dimension larger than that of said second segment; and means for retaining said torque cap in said second end or said radially penetrating hole.

2. The screwdriver of claim 1 wherein said torque cap retaining means comprises a pair of detent balls disposed in said first and second segments of said torque cap, to engage said radially penetrating hole.

3. The screwdriver of claim 2 further comprising a shirt pocket clip attached to said hollow shaft for removably attaching said shaft to a shirt pocket.

4. The screwdriver of claim 1 further comprising a shirt pocket clip attached to said hollow shaft for removably attaching said shaft to a shirt pocket.

5. The screwdriver of claim 4 wherein the plurality of tool bits further comprises:

a standard blade bit for driving slotted head screws; and a Phillips head bit for driving Phillips head screws.

6. The screwdriver of claim 1 wherein the plurality of tool bits further comprises:

a standard blade bit for driving slotted head screws; and a Phillips head bit for driving Phillips head screws.

* * * * *